United States Patent [19]

Finsterwalder

[11] Patent Number: 4,480,348

[45] Date of Patent: Nov. 6, 1984

[54] TENSION-BAND BRIDGE

[76] Inventor: Ulrich Finsterwalder, Pagodenburgstrasse 8, 8000 Munchen, Fed. Rep. of Germany

[21] Appl. No.: 477,729

[22] Filed: Mar. 22, 1983

[30] Foreign Application Priority Data

Mar. 30, 1982 [DE] Fed. Rep. of Germany ..... 3211790

[51] Int. Cl.[3] ..... E01D 11/00

[52] U.S. Cl. ..... 14/18; 14/8; 14/73; 14/6; 52/87

[58] Field of Search ..... 14/18, 20, 8, 11, 6, 14/17, 5, 16.5, 13, 4, 73; 52/167, 87, 602; 264/32

[56] References Cited

U.S. PATENT DOCUMENTS

| | | | |
|---|---|---|---|
| 2,155,121 | 4/1939 | Finsterwalder | 14/17 X |
| 3,088,246 | 5/1963 | Thiman | 52/87 X |
| 3,132,363 | 5/1964 | Roberts | 14/73 X |
| 3,230,560 | 1/1966 | Finsterwalder | 14/18 |
| 3,418,768 | 12/1968 | Cardan | 52/167 |
| 3,421,167 | 1/1969 | Kawada | 14/18 |
| 3,822,428 | 7/1974 | Stog et al. | 14/16.5 |
| 4,192,120 | 3/1980 | Richard et al. | 52/87 X |
| 4,223,495 | 9/1980 | Peter | 52/87 X |
| 4,282,619 | 8/1981 | Rooney | 14/6 |

FOREIGN PATENT DOCUMENTS

| | | | |
|---|---|---|---|
| 1273164 | 7/1968 | Fed. Rep. of Germany | 14/17 |
| 1286286 | 8/1969 | Fed. Rep. of Germany . | |
| 1658588 | 2/1973 | Fed. Rep. of Germany . | |
| 594789 | 1/1978 | Switzerland . | |

OTHER PUBLICATIONS

Ulrich Finsterwalder, 50 *Jahre fur Dywidag,* published by Dyckerhoff & Widmann, Munich, Verlag G. Braun, Karlsruhe 1973, pp. 172–183.

*Primary Examiner*—Stephen J. Novosad
*Assistant Examiner*—Beverly E. Hjorth
*Attorney, Agent, or Firm*—Hayes, Davis & Soloway

[57] ABSTRACT

A tension-band bridge having one or more main openings (2) and possibly subsidiary openings (3), comprises a tension band (4) gripped between abutments (5) and possibly taken over supporting pillars (6). The traffic route over the bridge is disposed on a saddling (7), which bends in the longitudinal direction of the bridge, in the region of the main openings (2), while the tension band (4) can be travelled over directly in the region of any subsidiary openings (3) which may be present. The saddling which bends in the longitudinal direction of the bridge preferably consists of a latticework construction (10, 11, 12) which is rigid in the transverse direction of the tension band (4) and which is connected, in the longitudinal direction of the bridge, by means of diagonal struts (13) in each of which shock absorbers (14) are disposed.

6 Claims, 5 Drawing Figures

TENSION-BAND BRIDGE

The invention relates to tension-band bridges.

Tension-band bridges are true suspension bridges, the traffic route of which is supported on a reinforced concrete plate formed along a cable line. The prestressing bars of the tension-band bridge are gripped between abutments in which reinforcements are anchored. Depending on the dimensions of the bridge, this comprises a wide main opening or one or more main openings and additional narrower subsidiary openings. Tension-band bridges were hitherto built or designed with a tension band of reinforced concrete to be travelled over directly or with a torsionally rigid box girder of steel or reinforced concrete saddled on the tension band; c.f. commemorative volume Ulrich Finsterwalder, 50 Jahre fur Dywidag, published by Dyckerhoff & Widmann, Munich, Verlag G. Braun, Karlsruhe 1973, pages 172 et seq and 308 et seq. DE-PS No. 12 86 286, DE-PS No. 16 58 588 and U.S. Pat. No. 3,230,560 may be mentioned as further prior art.

If the tension band is travelled over directly in the case of a tension-band bridge, this is endangered or restricted in its usability by vibrations. Vibrations may, for example, be caused by wind if eddies with a frequency depending on the velocity of the wind coincide with the low natural frequency of the tension band. A tilting movement or torsional vibration about the longitudinal axis of the tension band may also occur as a result of a hurricane-like wind, for example. Vibrations may also be caused by the traffic, however, if the bending originating from the individual vehicles occurs at the same frequency as the natural frequency of the tension band. A further disadvantage is to be seen in the fact that a tension band travelled over at one side is stressed at the edge by about 30% more than with a full load distributed uniformly over the width of the tension band.

If the tension band is saddled with a torsionally rigid box, on which the traffic route is provided, the above disadvantages are eliminated. But the tension band loses its capacity to adapt itself to the variations in length as a result of temperature and the varying loads by minor changes in shape, without appreciable bending moments. Residual stresses result which complicate the system.

It is an object of the present invention to provide an improved tension-band bridge such that, even with large dimensions particularly of the main openings of the tension-band bridge, an economic production is possible and the problems mentioned can be overcome without great expense.

Accordingly the present invention consists in a tension-band bridge having a main opening or having main and subsidiary openings, the traffic route of which is supported on a reinforced concrete plate (tension band) which is formed along a cable line and which extends between abutments in which the reinforcements are anchored, or between abutments and piers, characterised in that in the case of the main openings a carriageway surfacing which bends in the longitudinal direction of the bridge is saddled onto the tension band and in the case of the subsidiary openings which may be present the tension band can be travelled directly.

Accordingly, the idea of the invention consists in saddling a carriageway surfacing which bends in the longitudinal direction of the bridge, on the tension band in the case of the wide main openings, while the tension band can be travelled over directly in the case of the narrower subsidiary openings. Such a construction with a saddling of a carriageway surfacing which bends in the longitudinal direction does not prevent the tension band from adopting the shape of the catenary curve caused by the traffic load. On the other hand, the saddling which bends in the longitudinal direction prevents the above-mentioned vibrations of the tension-band bridge from being able to occur. The subsidiary openings, on the other hand, are generally so narrow that here the tension band can be travelled over directly, because with such spans the problems regarding vibrations can be overcome.

The saddling is preferably divided into two parts by an expansion joint in the middle of the span of the tension band over the main opening or the main openings. As a result, the tension band can adapt itself to the variations in length as a result of temperature and alternating loads by minor changes in shape without appreciable bending moments and the saddling can follow these variations in length.

The saddling which bends in the longitudinal direction is preferably a latticework construction which is rigid in the transverse direction of the tension band and bends in the longitudinal direction of the tension band. This can be achieved, for example, by diagonal members in the longitudinal plane of the latticework, which are divided in their longitudinal direction and equipped with shock absorbers. Such a latticework system does not prevent the tension band from assuming the shape of the catenary curve caused by the traffic load. The shock absorbers present in the divided diagonal members ensure that no vibrations of the tension band occur, because these are prevented, already while nascent, by the damping through the shock absorbers.

In order to compensate for the said loading of the tension band in the event of unilateral loading, the tension band is preferably made wider by about 15% than the carriageway surfacing. The load distribution in the transverse direction is regulated by the prestressing of the tension band in the transverse direction and by cross members on the saddling.

The construction of the tension band is closely connected to the profile of inclination of the traffic route because the tension band generally does not end at the piers of the main opening but is taken further by subsidiary openings to abutments. As a result of the piers, the main opening constructed in the form of a trough is followed by an arch which, in the case of a modern high-speed traffic route, should have a radius of at least 8000 meters. A tension-band bridge according to the invention with a tension band travelled over directly at the subsidiary openings can follow this radius up to a span of about 80 meters. In this case, the tension band is so constructed that the prestressing bars bent under the dead weight of the tension band are fitted at the bottom inside the thickness of the tension band in the centre of the span in the cause of the subsidiary openings and at the top over the supports at both sides. As a result of this construction, the prestressing bars of the tension band stretched over the intermediate supports form a sagging polygon but the carriageway forms a prestressed concrete plate arched upwards. Sag of the tension band and arching of the carriageway can be accommodated within the thickness of the tension band.

A tension-band bridge according to the invention has two decisive advantages over tension-band bridges hitherto designed and executed.

The first advantage consists in that the radius of curvature of the tension band in the main openings no longer depends on the inclination of the carriageway but can be smaller. Since the inclination of a high-speed carriageway is restricted to about 5%, a tension band which was travelled over directly would require a radius of curvature of $L/(2\times0.05)$ corresponding to ten times the span. The economic limit would be exceeded, however, with a length L of 200 meters. Large spans in the main openings up to 400 meters and more can be achieved by the bending saddling of the traffic route, even through the inclination of the tension band at the two ends of the main opening may amount to about 15%. The height of the saddling is, of course, a limit for the saddling construction.

The second decisive advantage of the invention relates to the elimination of the vibrations caused by wind and traffic. The damping system of the tension-band bridge as a result of the saddling bending in the longitudinal direction at the main openings on the one hand does not hinder the movements of the tension band caused by the loads but reliably prevents a build-up of the bridge vibrations.

These two ideas render it possible to build bridges without a construction situated over the carriageway for large spans with low construction height. This is extremely desirable in many places, for example, because of air traffic.

Further advantages and developments of the invention are apparent from the claims and the following description in which an example of a tension-band bridge according to the invention is explained in more detail with reference to the drawing. In the drawing:

Figure 1:
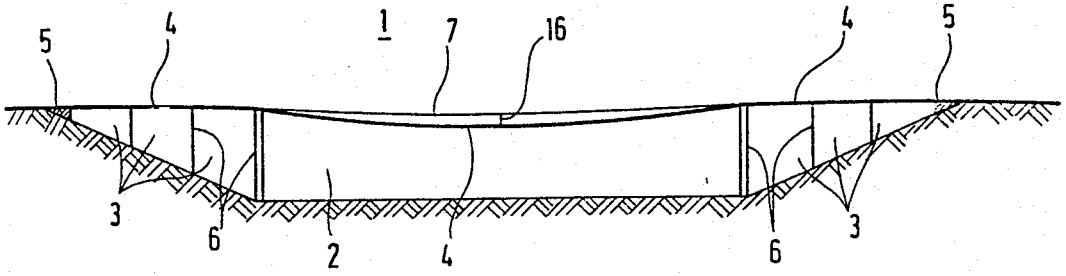
FIG. 1 shows a diagrammatic side view of a tension band bridge according to the invention with a main opening and two subsidiary openings at each side of the main opening.

In FIG. 1, a tension-band bridge 1 with a main opening 2 with a span of about 400 meters and at each side of the main opening, three subsidiary openings 3 with spans of about 70 meters is shown diagrammatically. The tension-band bridge spans a river, for example, with the main opening. The load-supporting element of the tension-band bridge is a tension band 4, for example of reinforced concrete with steel 42 50, which is gripped at both ends of the bridge in abutments 5 and from there is taken over the supporting pillars 6 defining the subsidiary openings and the main opening. In the region of the subsidiary openings 3, the tension band is travelled over directly by the traffic while in the region of the main opening 2 a saddling 7, which bends in the longitudinal direction of the tension band and carries the carriageway surfacing, is saddled over the sagging tension band 4. Over the whole length of the bridge, the tension band 4 is about 15% wider than the carriageway surfacing, and accordingly projects beyond the lateral boundaries of the saddling 7 in the region of the main opening 2. The tension band then has, for example, a width of 36 meters and a thickness of about 14 cm; with a span of about 400 meters, the tension band sags about 16 meters over the main opening, in the middle thereof; at this point the saddling has a height of about 10 meters so that the carriageway surfacing sags by about 6 meters between the boundary pillars of the main opening. From this there results a carriageway gradient of between 3 and 5%.

Figure 4:
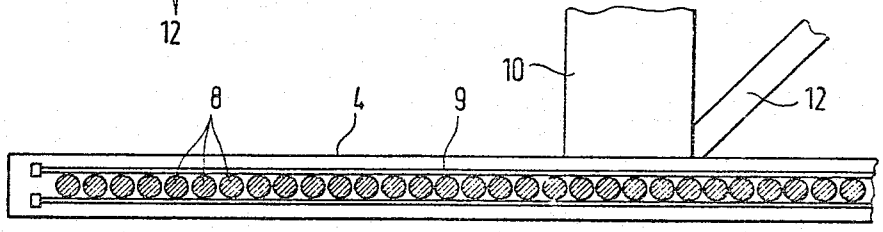
FIG. 4 shows a partial cross-section through the tension band of the tension-band bridge in the region of the saddling.

The tension band itself, as shown in FIG. 4, is a reinforced concrete construction with a large number of prestressing bars 8 which lie parallel and which, with the dimension of the tension-band bridge given above, have a diameter of 57 mm and extend side by side with a distance between their axes of 7 cm. For the given width of 36 meters, about 500 prestressing bars of steel are necessary in this manner. The tension band is also braced with prestressing bars 9 in the transverse direction, at both sides of the longitudinal prestressing bars 8; see FIG. 4.

Figure 2:
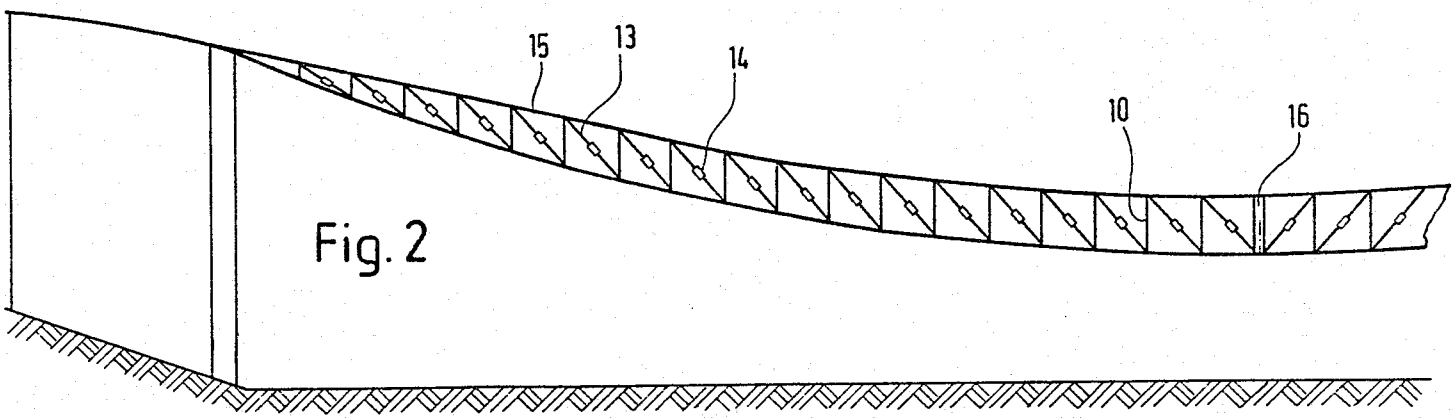
FIG. 2 shows a diagrammatic construction of the part of the tension-band bridge of the main opening with tension band and a saddled construction for the carriageway surfacing.
Figure 3:
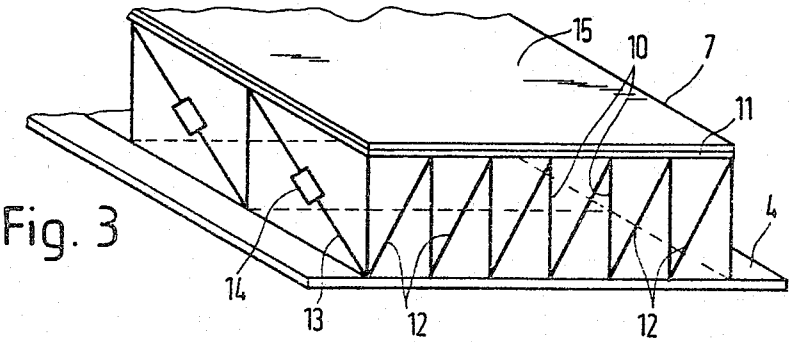
FIG. 3 shows a diagrammatic perspective view of a part of the saddling.

As can be seen from FIGS. 2 and 3, the construction of the saddling 7 is a latticework construction which is bending resistant in the transverse direction of the tension band but bends in the longitudinal direction of the tension band. In the simplest case, the latticework construction consists of vertical supports 10 mounted with slight spacing on the tension band and connected to one another at their upper ends by transverse struts 11. The supports of a row of latticework are reinforced by diagonal struts 12 so that the construction of supports 10, transverse struts 11 and diagonal struts 12 leads to a latticework frame which is rigid in the transverse direction. A plurality of such latticework frames is disposed over the length of the tension band in the region of the main opening. The outer supports of adjacent latticework frames are connected to one another by diagonal struts 13 in which shock absorbers 14 are disposed; see FIG. 3. The carriageway surfacing 15 is then mounted on this latticework structure which bends in the longitudinal direction.

As can be seen from FIGS. 1 and 2, the saddling 7 is divided in the middle of the main opening 2 by an expansion joint 16 of a few centimeters in width which is here shown only schematically.

Figure 5:
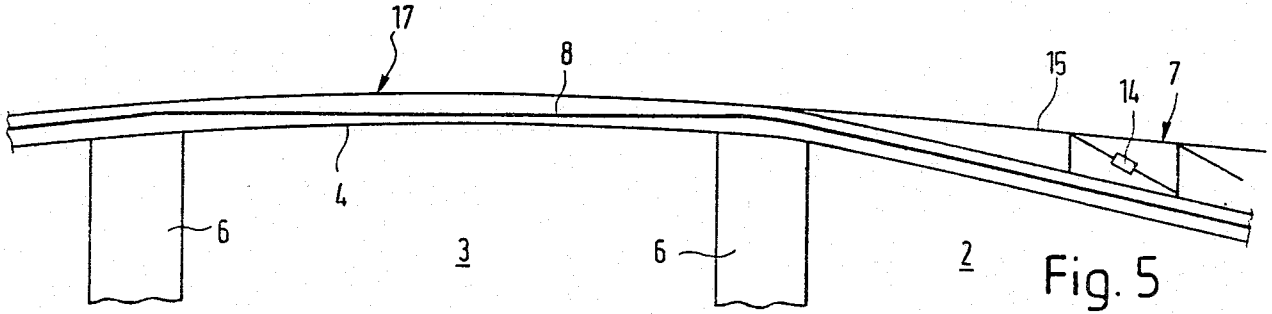
FIG. 5 shows a diagrammatic cross-section of the tension-band bridge in the region of a subsidiary opening adjacent to the main opening.

In FIG. 5, a part of the tension-band bridge in the region of the first subsidiary opening 3 following on the main opening 2 is shown. Over the span of the subsidiary opening 3, the tension band extending between the supporting pillars 6 only sags slightly, namely in the order of magnitude of up to about 10 cm. In order to make the course of the carriageway smooth at the transition from the main opening to the subsidiary opening, the gradient of the carriageway in the region of the main opening is generally followed by an arch 17 in the region of the subsidiary opening. In order to keep the conditions of visibility on the bridge favourable, the minimum radius of such arches should be in the region of 8000 meters. The arch can be produced without additional constructions such as supports as explained in connection with FIG. 5. For this purpose, the concrete round the prestressing bars 8 sagging only slightly is built up so that at the two supporting pillars 6 defining the subsidiary opening 2, the prestressing bars 8 lie inside the tension band 4 above the middle of the tension band while the prestressing bars in the middle of the span of the subsidiary opening 3 lie below the middle of the tension band. As a result of the slight sagging of the tension bands 8 with short spans, it is possible to form the arch directly through the tension band, because the main proportion of the concrete lies above the prestressing bars 8 in the middle of the span but below the prestressing bars in the region of the supporting pillars. Despite the prestressing bars 8 sagging downwards, the tension band 4 as a whole extends arched upwards, however.

Although in the above a tension-band bridge with only one main opening and a plurality of subsidiary openings has been described, the construction principles given naturally also apply for tension band bridges with only one single main opening or for tension band bridges with a plurality of main openings or a plurality of subsidiary openings.

What is claimed is:

1. A tension-band bridge having a main opening, the traffic route of which is supported on a reinforced concrete tension-band extending on a catenary line across the main opening between abutments in which the reinforcements are anchored, the tension-band is provided with a carriageway saddling forming the traffic route over the main opening, the saddling being a latticework construction which is rigid transversely of the tension-band but flexible longitudinally of the tension-band thereby to allow the saddling to follow the movements of the catenary line of the tension-band, the latticework construction of the saddling comprising latticework frames which are supported above and by the tension-band, adjacent latticework frames being connected to one another longitudinally of the tension-band, by diagonal struts in which shock absorbers are integrated to damp undesired vibrations in the tension band.

2. A tension-band bridge as claimed in claim 1, wherein the diagonal struts with the shock absorbers disposed therein are disposed only at the transversely outsides of the latticework frames.

3. A tension-band bridge as claimed in claim 1, wherein the saddling is divided, centrally of the main opening by an expansion joint extending transversely of the tension-band.

4. A tension-band bridge as claimed in claim 1, wherein the tension-band is transversely wider than the carriageway saddling.

5. A tension-band bridge as claimed in claim 4, wherein the tension-band is about 15% wider than the carriage saddling.

6. A tension-band bridge as claimed in claim 1, wherein the tension-band is prestressed in the transverse direction by prestressing bars.

* * * * *